US007010243B2

(12) United States Patent
Shimada

(10) Patent No.: US 7,010,243 B2
(45) Date of Patent: Mar. 7, 2006

(54) IMAGE FORMING DEVICE, IMAGE FORMING METHOD, AND PROGRAM PRODUCT

(75) Inventor: Tomoaki Shimada, Iruma-gun (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 40 days.

(21) Appl. No.: 10/805,390

(22) Filed: Mar. 22, 2004

(65) Prior Publication Data

US 2004/0223774 A1 Nov. 11, 2004

(30) Foreign Application Priority Data

May 6, 2003 (JP) ..... 2003-127906

(51) Int. Cl.
*G03G 15/00* (2006.01)

(52) U.S. Cl. ..... 399/111; 399/125

(58) Field of Classification Search ..... 399/27, 399/111, 25, 90, 125; 347/3, 23
See application file for complete search history.

(56) References Cited

U.S. PATENT DOCUMENTS 5,907,748 A * 5/1999 Kawana ..... 399/111
6,338,539 B1 * 1/2002 Kobayashi et al. ..... 347/23

FOREIGN PATENT DOCUMENTS

JP 10-078740 3/1998

* cited by examiner

*Primary Examiner*—Brij B. Shrivastav
(74) *Attorney, Agent, or Firm*—Buchanan Ingersoll PC

(57) ABSTRACT

If a printing instruction is received when a toner cartridge that needs to be replaced has been moved to the replacement position and is ready for replacement, the control unit of a printer controls each toner cartridge to move to a location where printing is possible and controls the toner cartridge that needs to be replaced to move back to the replacement position after the specified printing is completed.

25 Claims, 8 Drawing Sheets

IMAGE FORMING DEVICE, IMAGE FORMING METHOD, AND PROGRAM PRODUCT

This application is based on Japanese Patent Application No. 2003-127906 filed on May 6, 2003, the contents of which are hereby incorporated by reference.

BACKGROUND OF THE INVENTION

1. Field of the Invention

The present invention relates to an image forming device, an image forming method, and a program product. In particular, the invention relates to an image forming device capable of replacing any of a plurality of toner cartridges, an image forming method of forming image using said toner cartridges, and a program product for controlling said image forming device.

2. Description of the Related Art

A color printer has a plurality of toner cartridges and switches the toner cartridges in sequence to complete the developing process. In the field of this kind of printers, a toner cartridge rotary movement type color printer is known wherein a plurality of toner cartridges are loaded into a rotatable cartridge holding unit to be presented rotationally so that toners of various colors can be adhered to a photoconductor drum in sequence.

On a conventional toner cartridge rotary movement type color printer, when toner in a toner cartridge is almost gone and the toner cartridge becomes empty, a user is notified of the condition and prompted to replace the cartridge. When the user enters a command into the printer requesting to remove the toner cartridge that is empty, the particular toner cartridge is moved to a specified replacement position (e.g., Unexamined Publication No. JP-A-10-78740). Also known is a color printer ("LP-1500C", produced by SEIKO EPSON CORPORATION) wherein a toner cartridge is automatically moved to a specified replacement position when the toner cartridge becomes empty.

In case of the printer disclosed by the above mentioned Unexamined Publication No. JP-A-10-78740, the toner cartridge that is empty and needed to be replaced is moved to the replacement position only when the user operates the operating panel unit. However, since the cartridge holding unit of the printer rotates in one direction only, there is a problem that it takes a long time to move the empty toner cartridge to the specified replacement position.

On the other hand, on the printer ("LP-1500C", produced by SEIKO EPSON CORPORATION) that automatically moves an empty toner cartridge to the replacement position, printing cannot be executed until the toner cartridge that is located at the replacement position is replaced when an empty toner cartridge exists. However, it often happens that a small amount of toner is remaining in the toner cartridge even though it is detected to be empty. In such a case, the user cannot quickly acquire printed matters of particular urgency even though there may be usable tone left in the cartridge, making it inconvenient and also uneconomical as the toner cartridge with some toner remaining has to be replaced.

SUMMARY OF THE INVENTION

It is an object of the present invention to provide an image forming device, an image forming method, and a program product, which are improved for solving the abovementioned problems.

It is a more specific object of the present invention to provide an image forming device, an image forming method, and a program product that are capable of replacing toner cartridges of various colors easily, quickly acquiring desired printed matters, and reducing the running cost.

According to an aspect of the invention, there is provided an image forming device capable of replacing any of a plurality of cartridges comprising: a driving unit for moving the position of the toner cartridge; a detecting unit for detecting necessity of replacing a toner cartridge; a control unit for controlling said driving unit in order to move a toner cartridge that needs to be replaced to a specified replacement position preset for toner cartridge replacement, when the necessity of replacing a toner cartridge is detected by said detecting unit; and a receiving unit for receiving a printing instruction, wherein said control unit further controls said driving unit in order to move each toner cartridge to a printable position, and to move the toner cartridge that needs to be replaced back to said replacement position after a specified printing is completed, when a printing instruction is received by said receiving unit while the toner cartridge that needs to be replaced has been moved to said replacement position and is ready to be replaced.

According to this invention, a control is provided to move each toner cartridge to a printable position when a printing instruction is received even after a toner cartridge that needs to be replaced has been moved to the replacement position. This makes it possible to get printed matters quickly that are urgently needed, and also makes it possible to use a cartridge where a small amount of toner still exists, thus making it possible to reduce the running cost. Also, since a toner cartridge that needs replacement is always moved to the replacement position to wait for replacement, the user can easily remove the toner cartridge that needs replacement with a fresh one without requiring any additional manipulations.

According to another aspect of the invention, there is provided an image forming method for forming image using a plurality of replaceable toner cartridges comprising the steps of: 1) detecting necessity of replacing a toner cartridges; and 2) controlling a driving unit for moving the position of the toner cartridge in order to move a toner cartridge that needs to be replaced to a specified replacement position preset for toner cartridge replacement, when the necessity of replacing a toner cartridge is detected in step 1), wherein step 2) includes a step of controlling said driving unit in order to move each toner cartridge to a printable position, and to move the toner cartridge that needs to be replaced back to said replacement position after a specified printing is completed, when a printing instruction is received while the toner cartridge to be replaced has been moved to said replacement position and is ready to be replaced.

According to still another aspect of the invention, there is provided a program product for controlling an image forming device capable of replacing any of a plurality of cartridges, said program product causing the image forming device to execute a process comprising the steps of: 1) detecting necessity of replacing toner cartridges; and 2) controlling a driving unit for moving the position of the toner cartridge in order to move a toner cartridge that needs to be replaced to a specified replacement position preset for toner cartridge replacement, when the necessity of replacing a toner cartridge is detected in step 1), wherein step 2) includes a step of controlling said driving unit in order to move each toner cartridge to a printable position, and to move the toner cartridge that needs to be replaced back to said replacement position after a specified printing is completed, when a printing instruction is received while the toner cartridge to be replaced has been moved to said replacement position and is ready to be replaced.

The objects, characteristics and properties of this invention other than those set forth above will become apparent from the description given herein below with reference to preferred embodiments illustrated in the accompanying drawings.

DETAILED DESCRIPTION OF THE PREFERRED EMBODIMENTS

The embodiments of this invention will be described below with reference to the accompanying drawings.

Figure 1:
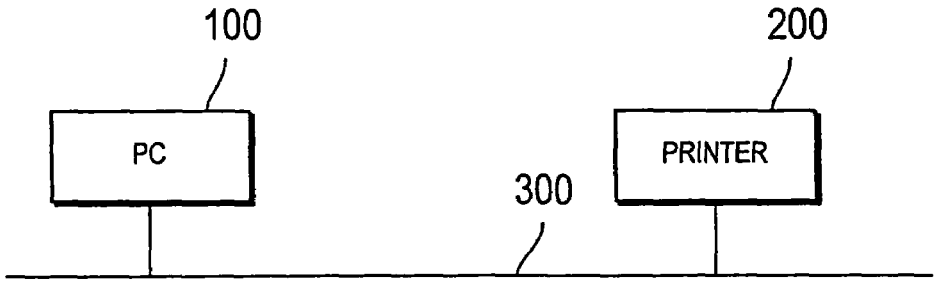
FIG. 1 is a block diagram showing the constitution of a printing system wherein an image forming device according to an embodiment of the present invention is applied.

FIG. 1 is a block diagram showing the constitution of a printing system wherein an image forming device according to an embodiment of the present invention is applied.

As shown in FIG. 1, the printing system is equipped with a PC (personal computer) 100 as well as a printer 200 serving as an image forming device, both of which are connected communicably with each other via a network 300. The network 300 can be a LAN based on standards such as Ethernet®, Token Ring, FDDI, etc., or a WAN consisting of LANs connected by, for example, a dedicated line.

The types and the number of equipment to be connected to the network are not limited to those shown in FIG. 1. The printer 200 can be connected directly with the PC 100 (local connection) without going through the network 300. In this case, an interface, such as USB and IEEE 1284, is used.

Figure 2:
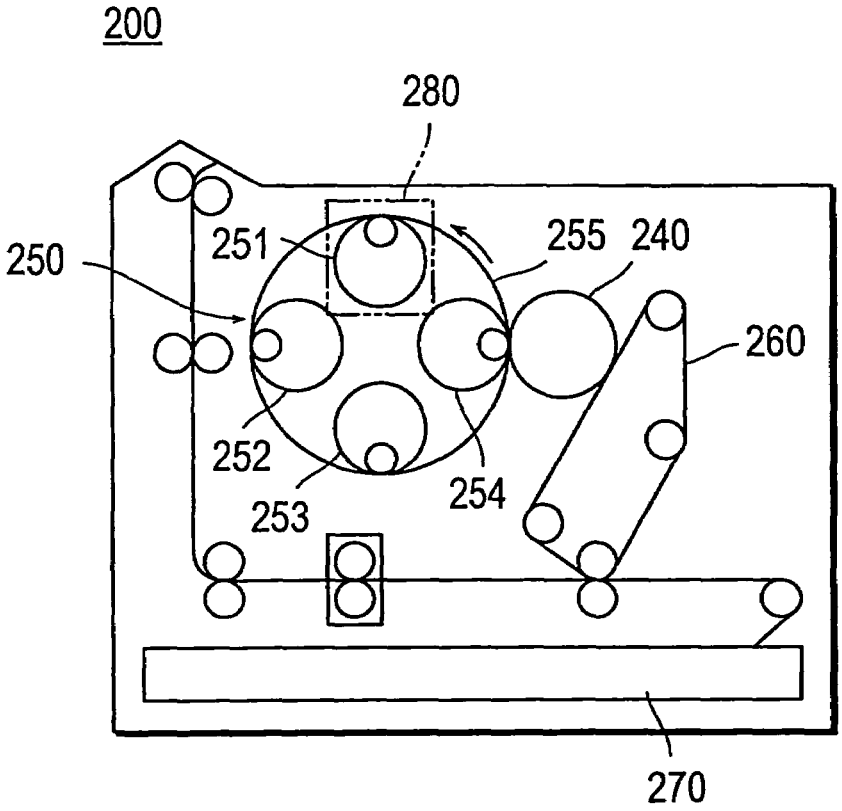
FIG. 2 is a schematic cross section showing the internal constitution of a printer shown in FIG. 1.

FIG. 2 is a schematic cross section showing the internal constitution of the printer 200 shown in FIG. 1. As shown in FIG. 2, the printer 200 has a photoconductor drum 240 for forming electrostatic latent image on its surface by being irradiated by laser light, and a developing device 250 for developing an image by causing four color toners sequentially adhered on the photoconductor drum 240. The developing device 250 is equipped with toner cartridges 251–254 of four different colors, i.e., cyan (C), magenta (M), yellow (Y), and black (K), and a cartridge holding unit 255 for holding these four toner cartridges 251–254 in a replaceable manner. The cartridge holding unit 255 can rotate around a center axis. Each of the toner cartridges 251–254 becomes ready for developing when it is placed on a position facing the photoconductor drum 240 (right side position in the drawing).

In the drawing, reference numeral "280" indicates the predesignated cartridge replacement position (upper side in the drawing). Each of the toner cartridges 251–254 becomes ready for replacement by the user when it is placed on the replacement position 280. The replacement position 280 of the toner cartridge is not limited to one position but rather can be arbitrarily set up at a number of positions less than the number of the toner cartridges provided on the printer 200 (four in this case).

The photoconductor drum 240 gets developed by the toner cartridge of one color while it makes one rotation, and the toner image thus acquired is transferred to an intermediate transfer belt 260. While the photoconductor drum 240 makes four rotations, the toner image of each color is successively transferred on to the intermediate transfer belt 260. Next, the four color toner images laid on top of each on the intermediate transfer belt 260 are transferred altogether onto paper supplied from a paper cassette 270 to form an image on the paper.

Figure 3:
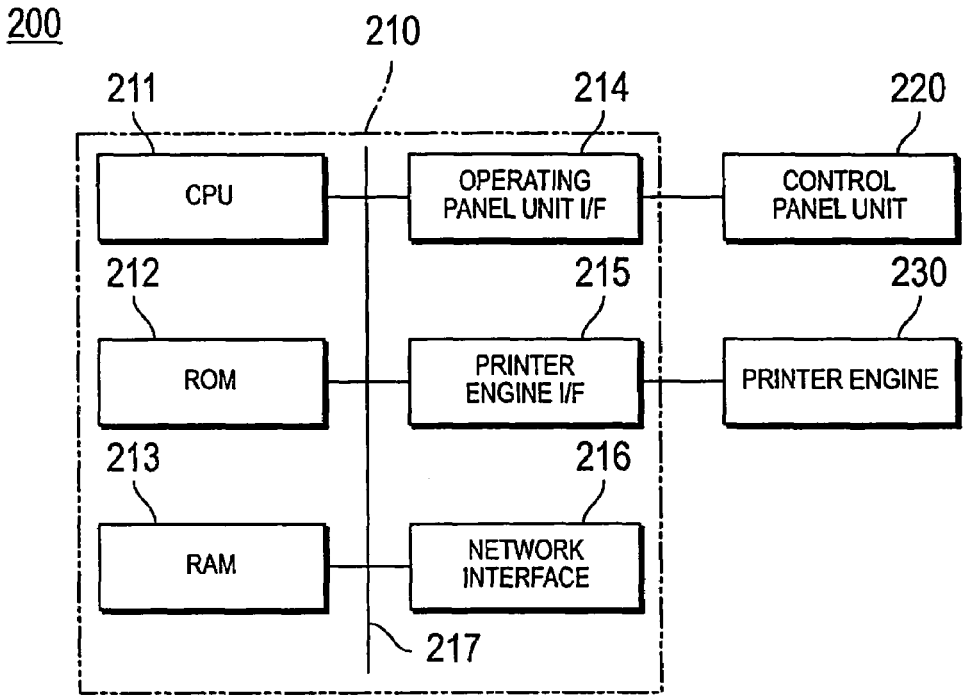
FIG. 3 is a block diagram showing the constitution concerning the control of the printer shown in FIG. 1.

FIG. 3 is a block diagram showing the constitution concerning the control of the printer 200 shown in FIG. 1. As shown in FIG. 3, the printer 200 has a printer controller 210 for processing the received data, an operating panel unit 220 that is used for displaying various kinds of information and entering various instructions, and a printer engine 230 for performing a printing process of the data transferred from the printer controller 210.

The printer controller 210 includes a CPU 211 for conducting the overall control of the printer 200 and various arithmetic processes of the printer 200, a ROM 212 for storing programs and data, a RAM 213 for temporarily storing programs and data as a working area, an operating panel unit interface 214 for connecting with the operating panel unit 220, a printer engine interface 215 for connecting with the printer engine 230, and a network interface 216 such as a LAN card for connecting with the network 300, all of which are interconnected via a bus 217 for exchanging signals with each other. The ROM 212 can store font information concerning fonts of characters. The RAM 213 can store the data received from the PC 100 temporarily.

Figure 4:
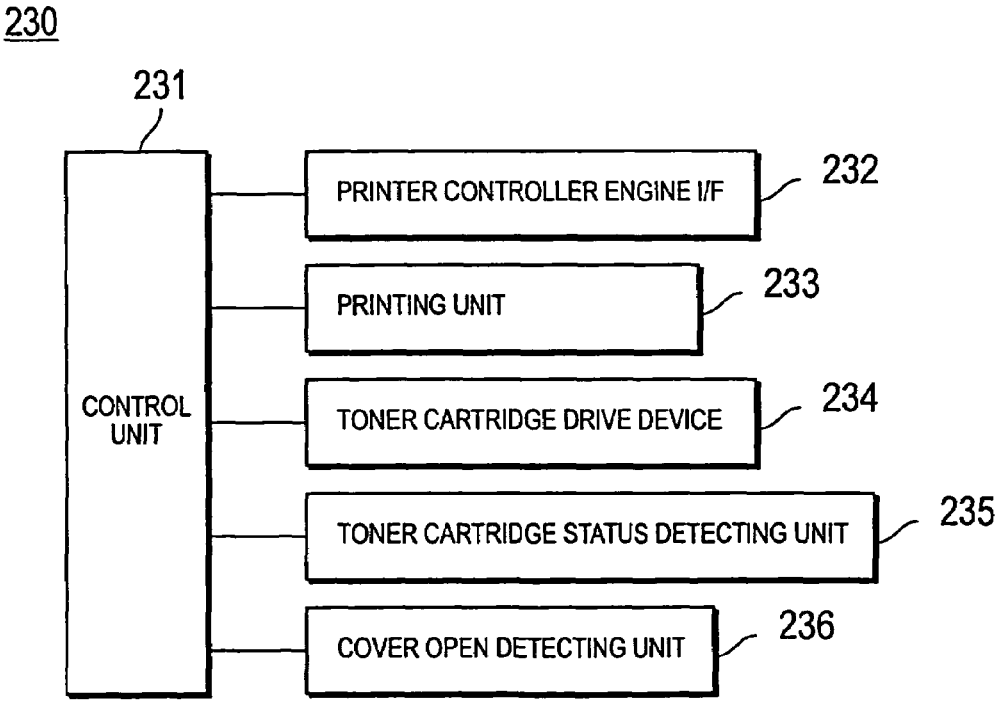
FIG. 4 is a block diagram showing the constitution concerning the control of a printer engine shown in FIG. 3.

FIG. 4 is a block diagram showing the constitution concerning the control of the printer engine 230 shown in FIG. 3. As shown in FIG. 4, the printer engine 230 includes a control unit 231 for overall control of the printer engine 230 and various arithmetic processes, a printer controller interface 232 for connecting with the printer controller 210, a printing unit 233 for printing various data on recording element such as paper using commonly known image forming processes such as the electronic photography process, a toner cartridge drive device 234 for moving the positions of toner cartridges 251–254, a toner cartridge status detecting unit 235 for detecting the status related to the necessity of replacing the toner cartridges, and a cover open detecting unit 236 for detecting the opening of a printer cover (not shown) for covering the front (the proximal side of FIG. 2) of the printer 200. The exchange of the toner cartridge is done while the printer cover is open.

The printing unit 233 includes the photoconductor drum 240, the developing device 250, and the intermediate transfer belt 260. The toner cartridge drive device 234 is equipped with a motor (not shown) as a rotary driving unit in order to rotate the cartridge holding unit 255 in the direction indicated by an arrow in FIG. 2 (counterclockwise direction).

The toner cartridge status detecting unit 235 is equipped with a near-emptiness sensor for cyan, a near-emptiness sensor for magenta, a near-emptiness sensor for yellow, and a near-emptiness sensor for black (none of these shown) for detecting the statuses of cyan, magenta, yellow, and black toner cartridges 251–254. The near-emptiness sensor for each color issues an ON signal when it detects that the particular toner cartridge is nearly empty, i.e., the toner in the toner cartridge is almost gone. The cover open detecting unit 236 is equipped with a cover open sensor (not shown) that issues an ON signal when the printer cover is opened toward the user, and issues an OFF signal when it is closed.

The printer 200 may include constitutional elements other than those described above, or may not include a portion of the abovementioned elements.

Next, a process concerning the replacement of a toner cartridge performed in the printer 200 will be described below referring to FIG. 5 through FIG. 10. The algorithm shown in the flowcharts of FIG. 5 through FIG. 10 is, for example, stored as a program in a storage unit such as a ROM (not shown) provided in the control unit 231 of the printer engine 230 and executed by the control unit 231.

When the printer 200 is powered up, an initialization process is conducted first (S101). The control unit 231 controls the toner cartridge drive device 234 so that the toner cartridge of each color can be positioned in the initial position as shown in FIG. 2. In other words, the cyan toner cartridge 251 is positioned at the replacement position 280 at the initial position of the toner cartridge.

Next, a process of acquiring the status of the toner cartridge is conducted (S102). In other words, the status of the toner cartridge is acquired based on the output signal received from the toner cartridge status detecting unit 235.

Figure 6:
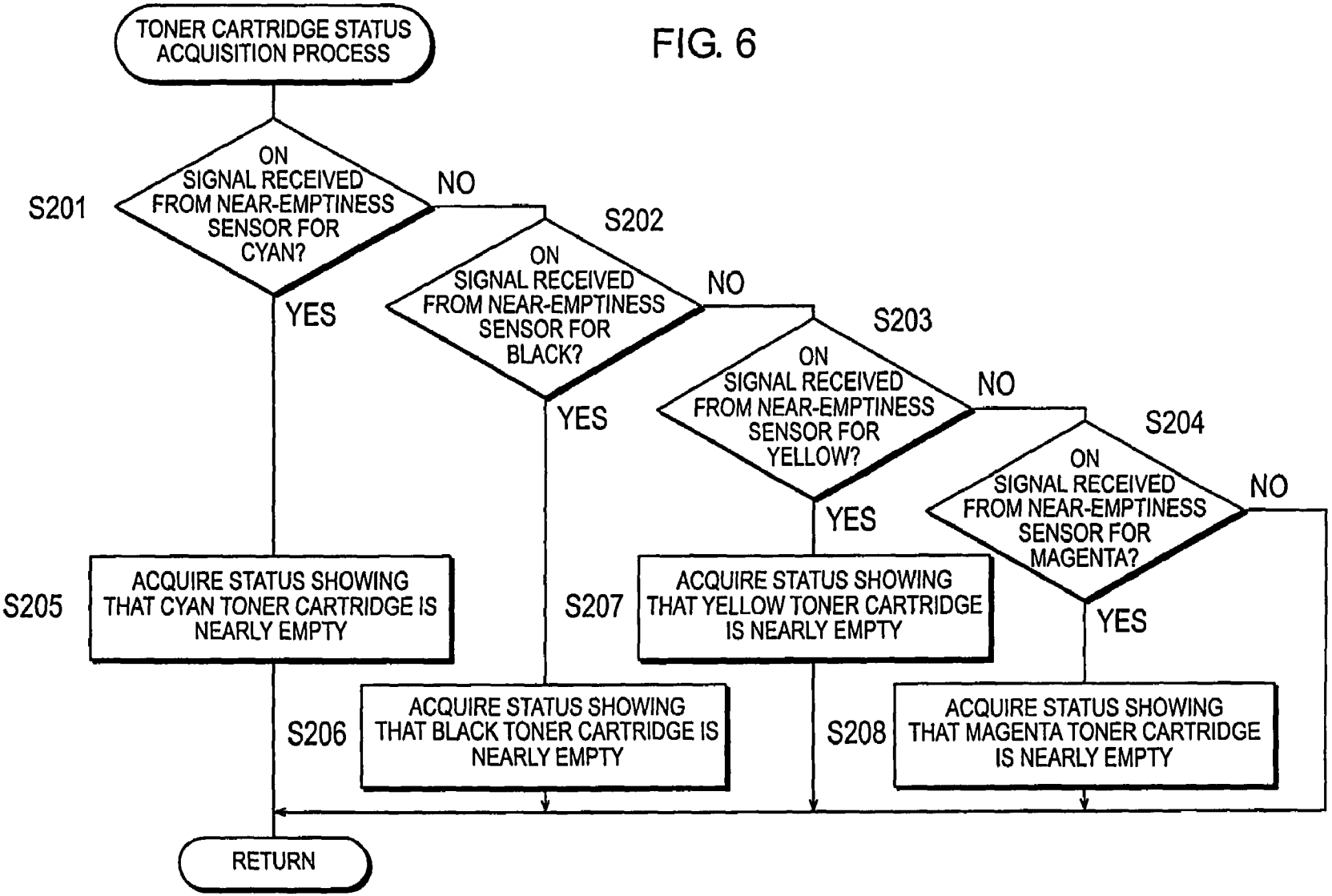
FIG. 6 is a flowchart for describing the status acquisition process for the toner cartridge shown in FIG. 5.

More specifically, as shown in the flowchart of FIG. 6, when the ON signal is received from the cyan near-emptiness sensor (S201: Yes), the status showing that the cyan toner cartridge is nearly empty is acquired (S205). Also, when the ON signal is not received from the cyan near-emptiness sensor (S201: No) and the ON signal is received from the black near-emptiness sensor (S202: Yes), the status showing that the black toner cartridge is nearly empty is acquired (S206). Also, when the ON signal is not received from both the cyan and black near-emptiness sensors (S201 and S202: No) and the ON signal is received from the yellow near-emptiness sensor (S203: Yes), the status showing that the yellow toner cartridge is nearly empty is acquired (S207). Also, when the ON signal is not received from any of the cyan, black and Yellow near-emptiness sensors (S201 through S203: No) and the ON signal is received from the magenta near-emptiness sensor (S204: Yes), the status showing that the magenta toner cartridge is nearly empty is acquired (S208). When no ON signal is received from any of the near-emptiness sensors (S201 through S204: No), the status of the toner cartridge stays in the initial default value indicating that none of the toner cartridges is empty.

As can be seen from the above, the output signal of the near-emptiness sensor for each color is checked and the status of each of them is acquired in the order of cyan, black, yellow, and magenta. This is designed so that the replacement work can be done efficiently considering the fact that cyan toner cartridge 251 is positioned at the replacement position 280 in the initial position of each toner cartridge, and that, as the cartridge holding unit 255 is rotated from the initial position, the cartridges appear on the replacement position 280 in the order of black, yellow, and magenta. The preferential order of each color is changeable.

Figure 5:
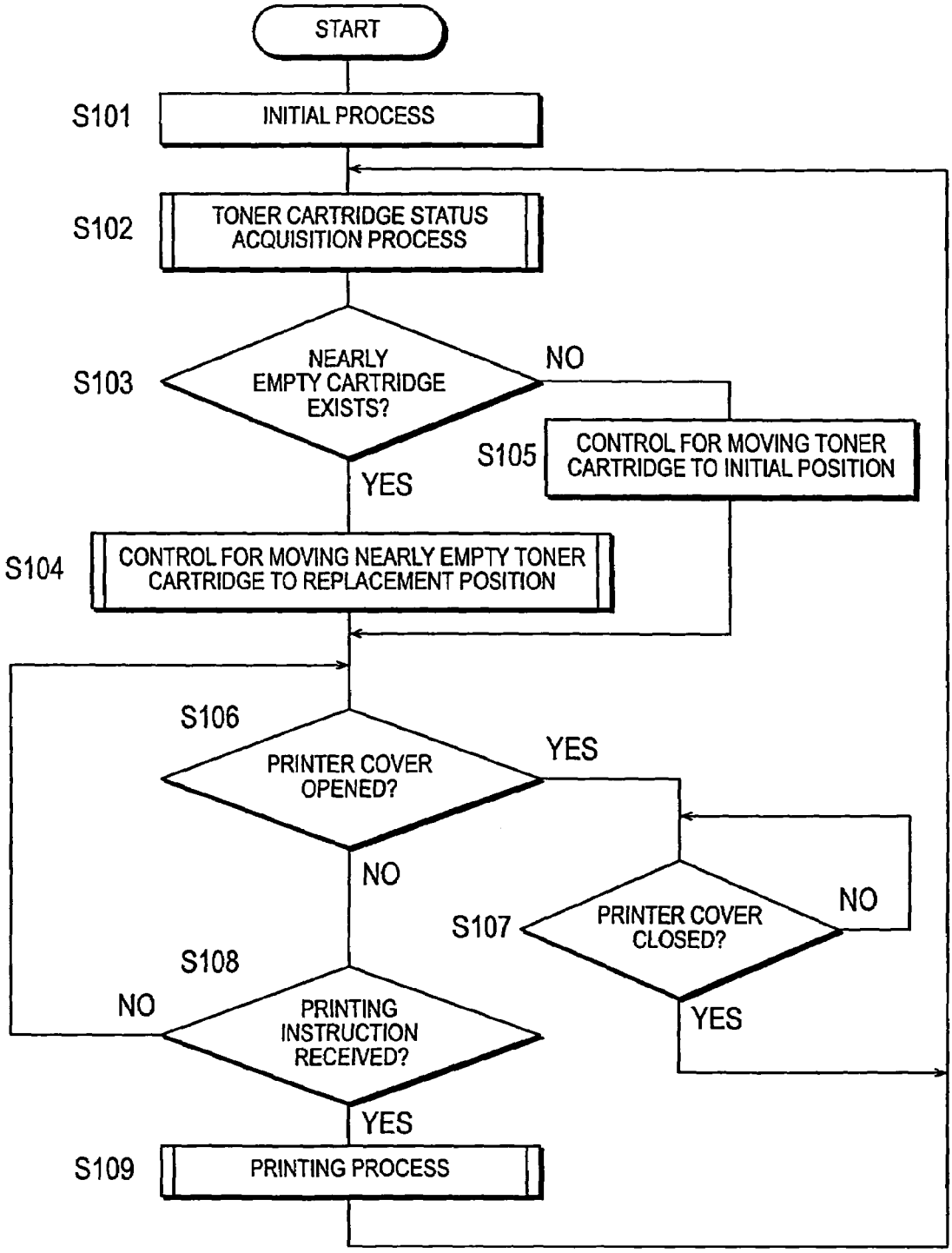
FIG. 5 is a flow chart for describing a process concerning the replacement of a toner cartridge performed in the printer.

Getting back to the description of FIG. 5, a judgment is made as to whether any nearly empty toner cartridge exists or not in step S103. In other words, a judgment is made as to whether the status is acquired showing any toner cartridge is nearly empty or not in step S102.

If a nearly empty toner cartridge exists (S103: Yes), a control for moving the toner cartridge to the replacement position will be performed (S104). In other words, the control unit 231 controls the toner cartridge drive device 234 in order to move the nearly empty toner cartridge to the replacement position 280 based on the toner cartridge status thus acquired.

Figure 7:
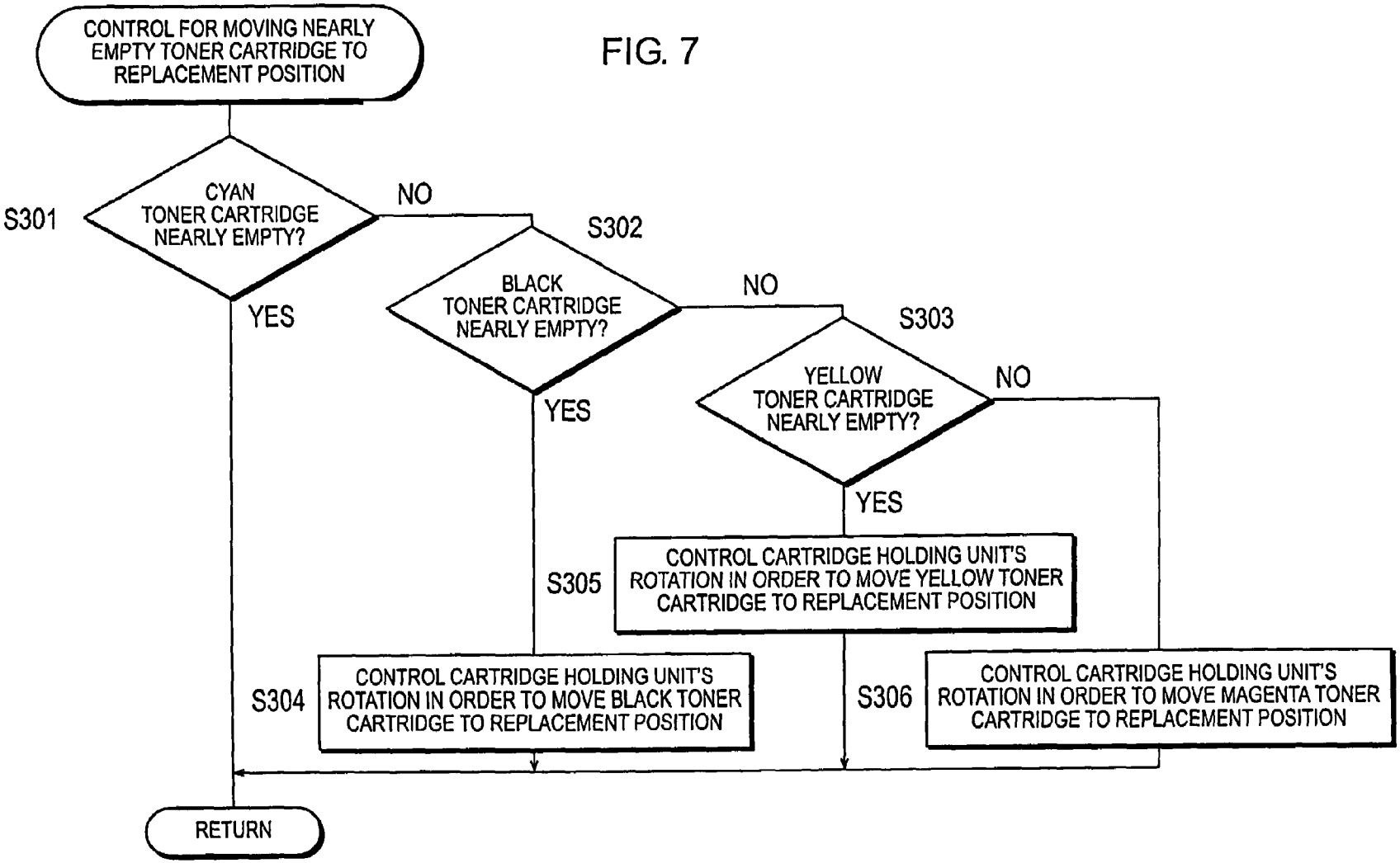
FIG. 7 is a flowchart for describing a control for moving the nearly empty toner cartridge shown in FIG. 5 to a replacement position.

More specifically, as shown in the flowchart of FIG. 7, if the status showing the near emptiness of cyan toner cartridge 251 is obtained, it is controlled to maintain the toner cartridge of each color in the original position, (S301: Yes). This is because the cyan toner cartridge 251 is located at the replacement position 280 in the initial position. If the status showing the near emptiness of the cyan toner cartridge 251 is not acquired (S301: No), and the status showing the near emptiness of the black toner cartridge 254 is acquired (S302: Yes), it is controlled to move the black toner cartridge 254 to the replacement position 280 (S304). If it is a movement from the initial position in this case, the cartridge holding unit 255 will be rotated 90 degrees counterclockwise in FIG. 2. If the statuses showing the near emptiness of the cyan and black toner cartridges 251 and 254 are not acquired (S301 and S302: No), and the status showing the near emptiness of the yellow toner cartridge 253 is acquired (S303: Yes), it is controlled to move the yellow toner cartridge 253 to the replacement position 280 (S305). If it is a movement from the initial position in this case, the cartridge holding unit 255 will be rotated 180 degrees counterclockwise. If the statuses showing the near emptiness of the cyan, black and yellow toner cartridges 251, 254 and 253 are not acquired (S301 through S303: No), and the status showing the near emptiness of the magenta toner cartridge 252 is acquired, it is controlled to move the magenta toner cartridge 252 to the replacement position 280 (S306). If it is a movement from the initial position in this case, the cartridge holding unit 255 will be rotated 270 degrees counterclockwise.

Getting back to the description of FIG. 5, a judgment is made as to whether the printer cover is opened or not based on the output signal received from the cover open detecting unit 236 in step S106. In other words, a judgment is made as to whether the ON signal is received from the cover open sensor or not.

When the printer cover is open (S106: Yes), it waits until the printer cover is closed, i.e., until an OFF signal is received from the cover open sensor (S107). During this time, the user can easily exchange with a new cartridge the nearly empty toner cartridge, which has been moved and presented at the replacement position 280. When the printer cover is closed (S107: Yes), the program returns to step S102.

On the other hand, if it is judged that a nearly empty toner cartridge exists in step S103 (S103: No), the control for moving each color toner cartridge to the initial position is conducted (S105). In other words, the control unit 231 controls the toner cartridge drive device 234 to cause each color toner cartridge to move to the initial position if each color cartridge is off the initial position after the nearly empty toner cartridge is replaced. Also, the control unit 231 controls each toner cartridge to maintain the position if it is in the initial position. After each toner cartridge is controlled to move to the initial position, the program advances to step S106.

In step S108, the control unit 231 makes a judgment whether an instruction for printing is received from the printer controller 210 or not (S108). If no instruction for printing is received (S108: No), the program returns to step S106.

If an instruction for printing is received (S108: Yes), a printing process is performed (S109). The printing unit 231 not only controls the printing unit 233, but also controls the toner cartridge drive device 234 to move each toner cartridge to a position where printing can be done. The detail of the printing process will be described later. After the printing process (S109) is completed, the program returns to step S102. Therefore, if a nearly empty toner cartridge exists and yet it is not replaced after printing, it provides a control to conduct the steps S102 through S104 again to return the particular toner cartridge to the replacement position.

Figure 8:
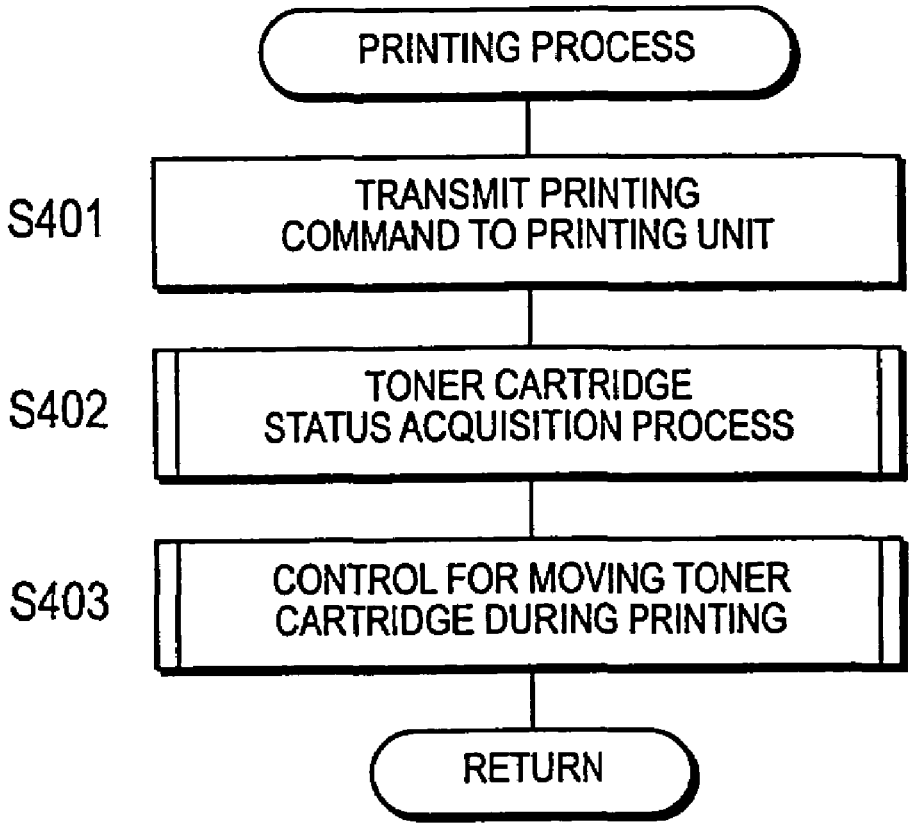
FIG. 8 is a flowchart for describing a printing process shown in FIG. 5.

FIG. 8 is a flowchart for describing a printing process in step S109 of FIG. 5.

First, the control unit 231 transmits a printing command to the printing unit 233 (S401). After receiving printing command, the printing unit 233 initiates an operation of printing data to be specified by the printing command in coordination with a control for moving the toner cartridge during printing (S403) to be described later.

After transmitting the printing command to the printing unit 233, a toner cartridge status acquisition process is conducted (S402). In other words, the status of the toner cartridge is acquired based on the output signal received from the toner cartridge status detecting unit 235. The process of this step S402 is identical to the process of step S102 so that the detail description is omitted here.

In step S403, the control for moving the toner cartridge during printing is performed. In other words, the control unit 231 controls the toner cartridge drive device 234 in order to move each toner cartridge to a position where printing is possible, i.e., development is possible, based on the toner cartridge status thus acquired.

Figure 9:
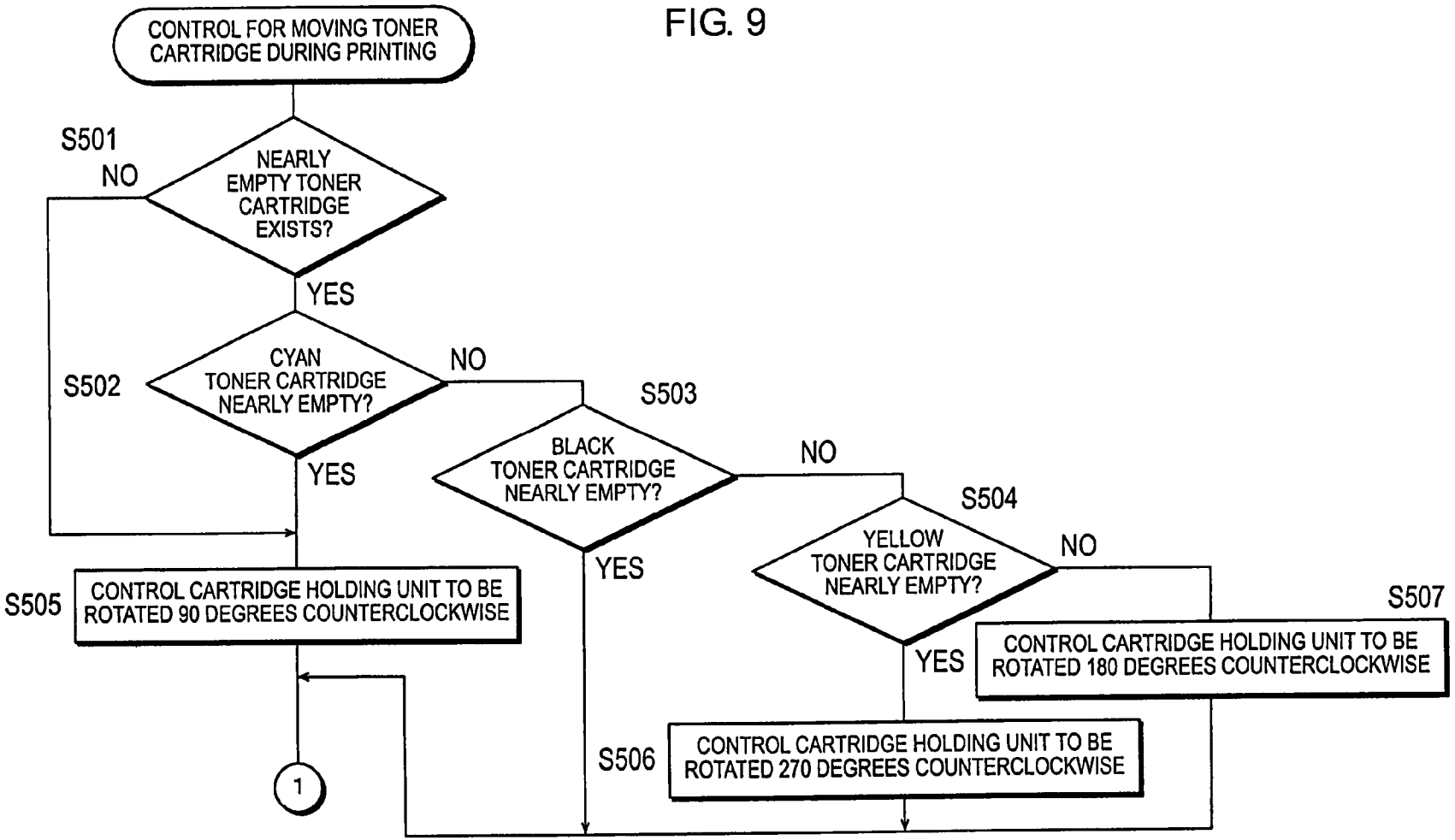
FIG. 9 is a flowchart for describing a control for moving the toner cartridge during printing cycle shown in FIG. 8.
Figure 10:
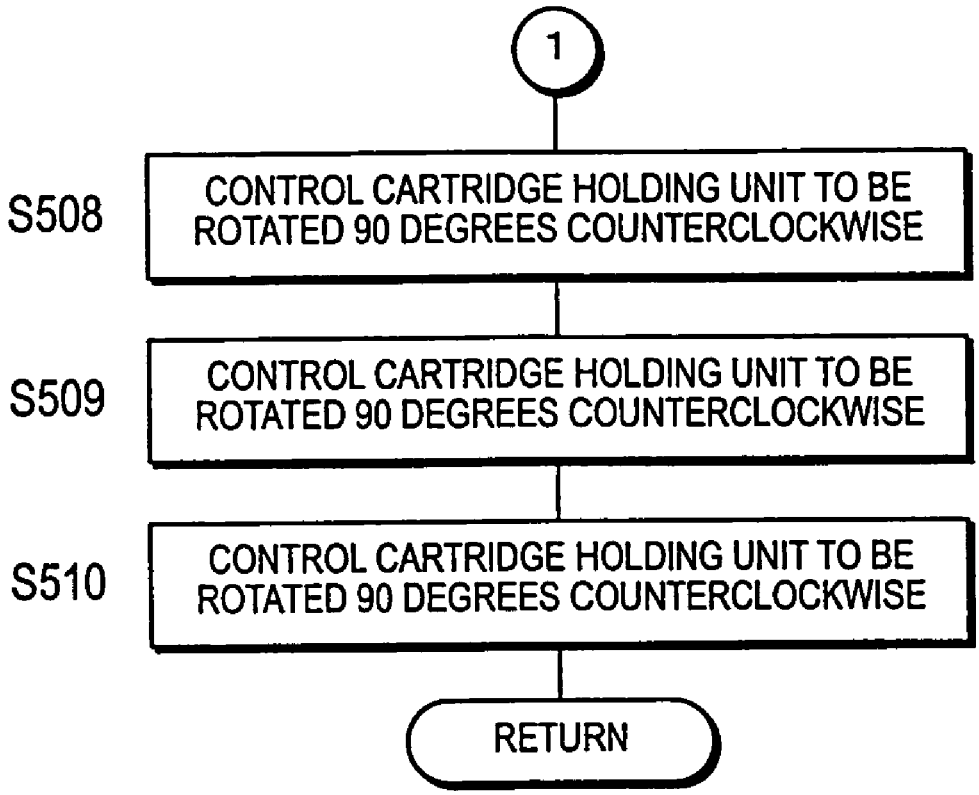
FIG. 10 is a flowchart for describing the control for moving the toner cartridge during the printing cycle continued from FIG. 9.

More specifically, as shown in the flowcharts of FIG. 9 and FIG. 10, the cartridge holding unit 255 is controlled to be rotated 90 degrees counterclockwise as shown in FIG. 2, if no nearly empty toner cartridge exists (S501: No), or the status showing the near emptiness of the cyan toner cartridge 251 is acquired (S502: Yes). If the status showing the near emptiness of the cyan cartridge 251 is not acquired (S502: No), and the status showing the near emptiness of the black toner cartridge 254 is acquired (S503: Yes), each toner cartridge is controlled to maintain the current position. If the statuses showing the near emptiness of the cyan and black cartridges 251 and 254 are not acquired (S502 and S503: No), and the status showing the near emptiness of the yellow toner cartridge 253 is acquired (S504: Yes), the cartridge holding unit 255 is controlled to be rotated 270 degrees in the counterclockwise direction. Furthermore, if a nearly empty toner cartridge exists (S501: Yes) and the statuses showing the near emptiness of the cyan, black and yellow cartridges 251, 254 and 253 are not acquired (S502 through S504: No), in other words, the status showing the near emptiness of the magenta toner cartridge 252 is near empty, the cartridge holding unit 255 is controlled to be rotated 180 degrees in the counterclockwise direction.

After processing either of steps S505 through S507, or after it is judged "Yes" in step S503, the yellow toner cartridge 253 is positioned at a location facing the photoconductor drum 240 (right side position in FIG. 2). At this point, the printing unit 233 conducts the yellow development. In other words, a yellow toner image is formed on the photoconductor drum 240. This yellow toner image is transferred to the intermediate transfer belt 260.

Next, the cartridge holding unit 255 is controlled to be rotated 90 degrees counterclockwise (S508). This causes the magenta toner cartridge 252 to be positioned at a location facing the photoconductor drum 240. At this point, the printing unit 233 conducts the magenta development. In other words, a magenta toner image is formed on the photoconductor drum 240. This magenta toner image is transferred to the intermediate transfer belt 260.

Next, the cartridge holding unit 255 is controlled to be rotated 90 degrees counterclockwise (S509). At this point, the printing unit 233 conducts the cyan development.

Next, the cartridge holding unit 255 is controlled to be rotated 90 degrees counterclockwise (S510). At this point, the printing unit 233 conducts the black development. Then, the toner images of four colors laid on top of each other on the intermediate transfer belt 260 are transferred to the printing paper altogether.

As can be seen from the above, it is so controlled in this embodiment that, if a printing instruction is received when a toner cartridge that needs to be replaced has been moved to the replacement position 280 and is ready for replacement, the control unit 231 of the printer 200 controls each toner cartridge 251 through 254 to move to a location where printing is possible and controls said toner cartridge that needs to be replaced to move back to the replacement position 280 after the specified printing is completed.

Therefore, the system controls each toner cartridge to move to the printable position when a printing instruction is received even after a toner cartridge that needs to be replaced has been transferred to the replacement position. This makes it possible to get printed matters quickly that are urgently needed, and also makes it possible to use a cartridge where a small amount of toner still exists, thus making it possible to reduce the running cost. Also, since a toner cartridge that needs replacement is always moved to the replacement position 280 to wait for replacement, the user can easily remove the toner cartridge that needs replacement with a fresh one without requiring any additional manipulations.

It is obvious that this invention is not limited to the particular embodiments shown and described above but may be variously changed and modified without departing from the technical concept of this invention.

For example, although it is so constituted in the above embodiment that the toner cartridge status detecting unit 235 detects the status concerning the toner cartridge replacement necessity based on the remaining amount of toner in a toner cartridge, the invention is not limited to it. It can be so constituted that the toner cartridge status detecting unit of the present invention detects the status concerning the necessity of the toner cartridge replacement based on other conditions such as the number of toner cartridge usage cycles, number of sheets printed, or functional malfunction occurrences.

The present invention is applicable not only to a printers but also to other image forming devices such as copying machines and MFPs (Multi-Functional Peripherals).

The means and method of conducting various processes in the image forming device according to the present invention can be realized by means of a dedicated hardware circuit, or a programmed computer. Said program can be provided either by a computer readable recording medium such as a flexible disk and a CD-ROM, or by being supplied on-line via a network such as the Internet. In this case, the program recorded on the computer readable recording medium is normally transferred to and stored in a storage unit such as a hard disk. Said program can also be provided as independent application software or can be built into the software of the image forming device as a part of its function.

In this invention, the program product includes the program itself and the computer readable recording medium on which the particular program is recorded.

What is claimed is:

1. An image forming device capable of replacing any of a plurality of cartridges comprising:

a driving unit for moving the position of the toner cartridge;

a detecting unit for detecting necessity of replacing a toner cartridge;

a control unit for controlling said driving unit in order to move a toner cartridge that needs to be replaced to a specified replacement position preset for toner cartridge replacement, when the necessity of replacing a toner cartridge is detected by said detecting unit; and a receiving unit for receiving a printing instruction, wherein said control unit further controls said driving unit in order to move each toner cartridge to a printable position, and to move the toner cartridge that needs to be replaced back to said replacement position after a specified printing is completed, when a printing instruction is received by said receiving unit while the toner cartridge that needs to be replaced has been moved to said replacement position and is ready to be replaced.

2. An image forming device as claimed in claim 1, further comprising:

a rotatable toner cartridge holding unit for holding the toner cartridges, wherein said driving unit has a rotary driving unit for rotating said cartridge holding unit.

3. An image forming device as claimed in claim 1, wherein said plurality of toner cartridges are toner cartridges of cyan, magenta, yellow, and black colors.

4. An image forming device as claimed in claim 2, wherein said plurality of toner cartridges are toner cartridges of cyan, magenta, yellow, and black colors.

5. An image forming device as claimed in claim 1, wherein said detecting unit detects the necessity of replacing a toner cartridge based on an amount of toner remaining in the toner cartridge.

6. An image forming device as claimed in claim 2, wherein said detecting unit detects the necessity of replacing a toner cartridge based on an amount of toner remaining in the toner cartridge.

7. An image forming device as claimed in claim 3, wherein said detecting unit detects the necessity of replacing a toner cartridge based on an amount of toner remaining in the toner cartridge.

8. An image forming device as claimed in claim 4, wherein said detecting unit detects the necessity of replacing a toner cartridge based on an amount of toner remaining in the toner cartridge.

9. An image forming method for forming image using a plurality of replaceable toner cartridges comprising the steps of:

1) detecting necessity of replacing a toner cartridges; and 2) controlling a driving unit for moving the position of the toner cartridge in order to move a toner cartridge that needs to be replaced to a specified replacement position preset for toner cartridge replacement, when the necessity of replacing a toner cartridge is detected in step 1), wherein step 2) includes a step of controlling said driving unit in order to move each toner cartridge to a printable position, and to move the toner cartridge that needs to be replaced back to said replacement position after a specified printing is completed, when a printing instruction is received while the toner cartridge to be replaced has been moved to said replacement position and is ready to be replaced.

10. An image forming method as claimed in claim 9, wherein said driving unit has a rotary driving unit for rotating a rotatable cartridge holding unit for holding the toner cartridges.

11. An image forming method as claimed in claim 9, wherein said plurality of toner cartridges are toner cartridges of cyan, magenta, yellow, and black colors.

12. An image forming method as claimed in claim 10, wherein said plurality of toner cartridges are toner cartridges of cyan, magenta, yellow, and black colors.

13. An image forming method as claimed in claim 9, wherein the necessity of replacing a toner cartridge is detected in step 1) based on an amount of toner remaining in the toner cartridge.

14. An image forming method as claimed in claim 10, wherein the necessity of replacing a toner cartridge is detected in step 1) based on an amount of toner remaining in the toner cartridge.

15. An image forming method as claimed in claim 11, wherein the necessity of replacing a toner cartridge is detected in step 1) based on an amount of toner remaining in the toner cartridge.

16. An image forming method as claimed in claim 12, wherein the necessity of replacing a toner cartridge is detected in step 1) based on an amount of toner remaining in the toner cartridge.

17. A program product for controlling an image forming device capable of replacing any of a plurality of cartridges, said program product causing the image forming device to execute a process comprising the steps of:

1) detecting necessity of replacing toner cartridges; and 2) controlling a driving unit for moving the position of the toner cartridge in order to move a toner cartridge that needs to be replaced to a specified replacement position preset for toner cartridge replacement, when the necessity of replacing a toner cartridge is detected in step 1), wherein step 2) includes a step of controlling said driving unit in order to move each toner cartridge to a printable position, and to move the toner cartridge that needs to be replaced back to said replacement position after a specified printing is completed, when a printing instruction is received while the toner cartridge to be replaced has been moved to said replacement position and is ready to be replaced.

18. A program product as claimed in claim 17, wherein said driving unit has a rotary driving unit for rotating a rotatable cartridge holding unit for holding the toner cartridges.

19. A program product as claimed in claim 17, wherein said plurality of toner cartridges are toner cartridges of cyan, magenta, yellow, and black colors.

20. A program product as claimed in claim 18, wherein said plurality of toner cartridges are toner cartridges of cyan, magenta, yellow, and black colors.

21. A program product as claimed in claim 17, wherein the necessity of replacing a toner cartridge is detected in step 1) based on an amount of toner remaining in the toner cartridge.

22. A program product as claimed in claim 18, wherein the necessity of replacing a toner cartridge is detected in step 1) based on an amount of toner remaining in the toner cartridge.

23. A program product as claimed in claim 19, wherein the necessity of replacing a toner cartridge is detected in step 1) based on an amount of toner remaining in the toner cartridge.

24. A program product as claimed in claim 20, wherein the necessity of replacing a toner cartridge is detected in step 1) based on an amount of toner remaining in the toner cartridge.

25. A program product as claimed in claim 17, which is a computer readable recording medium on which a program causing the image forming device to execute said process is recorded.

* * * * *